US010329854B2

(12) United States Patent
Rios et al.

(10) Patent No.: US 10,329,854 B2
(45) Date of Patent: Jun. 25, 2019

(54) TUBULAR TRANSFER SYSTEM AND METHOD

(71) Applicant: FORUM US, INC., Houston, TX (US)

(72) Inventors: Rogelio Rios, Spring, TX (US); Robert Arlen Holifield, Houston, TX (US); Robert Dugal, Spring, TX (US); Justin Wayne Triplett, Houston, TX (US)

(73) Assignee: FORUM US, INC., Houston, TX (US)

( * ) Notice: Subject to any disclaimer, the term of this patent is extended or adjusted under 35 U.S.C. 154(b) by 0 days.

(21) Appl. No.: 15/453,651

(22) Filed: Mar. 8, 2017

(65) Prior Publication Data

US 2018/0258714 A1 Sep. 13, 2018

(51) Int. Cl.

| | |
|---|---|
| ***E21B 19/14*** | (2006.01) |
| ***E21B 19/02*** | (2006.01) |
| ***E21B 19/20*** | (2006.01) |
| *E21B 19/06* | (2006.01) |

(52) U.S. Cl.

CPC ..... *E21B 19/02* (2013.01); *E21B 19/14* (2013.01); *E21B 19/20* (2013.01); *E21B 19/06* (2013.01)

(58) Field of Classification Search

CPC ..... E21B 19/14; E21B 19/20; B60P 1/5457
USPC ..... 212/179; 414/22.51–22.59, 22.61–22.69, 414/23, 24, 541–544, 561, 621, 718, 414/745.1, 745.2, 751.1; 901/14, 16
See application file for complete search history.

(56) References Cited

U.S. PATENT DOCUMENTS 3,561,811 A * 2/1971 Turner Jr. ..... E21B 19/14 294/104
3,615,027 A * 10/1971 Ham ..... E21B 19/14 414/137.5
3,633,767 A * 1/1972 Mitchell ..... E21B 19/14 414/22.68
3,709,379 A * 1/1973 Kaufeldt ..... B25J 9/023 414/591
3,768,663 A * 10/1973 Turner, Jr. ..... E21B 19/14 137/624.18
3,901,392 A * 8/1975 Streckert ..... B65G 57/04 414/792.9
3,921,823 A * 11/1975 Bourree ..... E21B 19/002 175/85
3,939,990 A * 2/1976 Johnson ..... E21B 19/155 414/22.58
3,976,207 A * 8/1976 Schultz ..... E21B 15/00 137/342
4,013,178 A * 3/1977 Brown ..... E21B 19/07 294/102.2
4,042,123 A * 8/1977 Sheldon ..... E21B 19/14 175/85

(Continued)

FOREIGN PATENT DOCUMENTS

DE 10344523 A1 4/2005

OTHER PUBLICATIONS

International Search Report and Written Opinion dated May 24, 2018, corresponding to Application No. PCT/US2018/017271.

*Primary Examiner* — Gregory W Adams
(74) *Attorney, Agent, or Firm* — Patterson + Sheridan, LLP

(57) ABSTRACT

A tubular transfer system comprising a boom structure having a first frame telescopically coupled to a second frame. A first actuator is configured to extend and retract the first frame relative to the second frame. A clamp mechanism is coupled to the first frame and configured to grip and lift a tubular. A second actuator is configured to raise and lower the clamp mechanism relative to the first frame.

12 Claims, 11 Drawing Sheets

(56) References Cited

U.S. PATENT DOCUMENTS

| | | | | | |
|---|---|---|---|---|---|
| 4,077,525 | A * | 3/1978 | Callegari | E21B 19/14 | 175/85 |
| 4,132,318 | A * | 1/1979 | Wang | B25J 13/082 | 294/86.4 |
| 4,187,546 | A * | 2/1980 | Heffernan | E21B 19/20 | 173/2 |
| 4,440,536 | A | 4/1984 | Scaggs | | |
| 4,462,733 | A * | 7/1984 | Langowski | E21B 19/14 | 254/415 |
| 4,582,133 | A * | 4/1986 | Tambs | E21B 19/20 | 166/77.51 |
| 4,610,315 | A * | 9/1986 | Koga | E21B 19/20 | 175/203 |
| 4,625,796 | A | 12/1986 | Boyadjieff | | |
| 4,791,997 | A * | 12/1988 | Krasnov | E21B 19/20 | 166/77.52 |
| 5,198,736 | A * | 3/1993 | Azuma | B25J 9/041 | 318/567 |
| 6,976,540 | B2 | 12/2005 | Berry | | |
| 7,246,983 | B2 | 7/2007 | Zahn et al. | | |
| 8,186,455 | B2 | 5/2012 | Childers et al. | | |
| 8,317,448 | B2 | 11/2012 | Hankins et al. | | |
| 8,936,424 | B1 | 1/2015 | Barnes et al. | | |
| 9,181,764 | B2 * | 11/2015 | Hu | E21B 19/20 | |
| 2002/0189804 | A1 * | 12/2002 | Liess | E21B 19/164 | 166/77.51 |
| 2008/0277953 | A1 * | 11/2008 | Condliff | B21J 15/02 | 294/104 |
| 2015/0314972 | A1 * | 11/2015 | Schenning | B65G 47/914 | 414/752.1 |
| 2016/0090796 | A1 | 3/2016 | Roodenburg et al. | | |
| 2017/0314343 | A1 | 11/2017 | Holand et al. | | |

* cited by examiner

TUBULAR TRANSFER SYSTEM AND METHOD

BACKGROUND

Field

Embodiments of the disclosure relate to a tubular transfer system and method for handling tubulars on a rig.

Description of the Related Art

On an oil and gas rig, one or more stands of tubulars are often made up and stored in an area, or setback, in proximity to the well center of the rig. An offline activity crane having a single joint elevator is used to handle the tubulars within the setback area for offline stand building, while a top drive having a top drive elevator is used to handle the tubulars at the well center. When needed, the tubular stands have to be transferred from the setback area to the well center and back again. However, the tubular stands can only be lifted at the same point by both the single joint elevator and the top drive elevator. Because of this, a derrickman or more are required to manually handle tubulars from the single joint elevator (or from a racking board) and move them to a position where the tubular can be latched by the top drive elevator and back again. This repetitive human interaction at high elevations on the rig puts the derrickman in close proximity to large moving equipment (e.g. the crane and the elevators) and creates a physically exertive and unsafe working condition.

Therefore, there exists a need for new and improved tubular transfer systems and methods.

SUMMARY

In one embodiment, a method of transferring a tubular from a stored location to a well center of an oil and gas rig using a tubular transfer system comprises moving the tubular from the stored location to a position near the tubular transfer system using a single joint elevator of an offline activity crane; actuating a clamp mechanism of the tubular transfer system to engage the tubular and relieve the weight of the tubular from the single joint elevator; extending and raising the clamp mechanism to move the tubular to a position for engagement with a top drive elevator; and automatically releasing the tubular from the clamp mechanism when the tubular is lifted from the clamp mechanism by the top drive elevator.

In one embodiment, a method of transferring a tubular from a well center to a stored location of an oil and gas rig using a tubular transfer system comprises moving the tubular from the well center to a position near the tubular transfer system; actuating a clamp mechanism of the tubular transfer system to engage the tubular and relieve the weight of the tubular from the top drive elevator; retracting and lowering the clamp mechanism to move the tubular to a position for engagement with a single joint elevator of an offline activity crane; and automatically releasing the tubular from the clamp mechanism when the tubular is lifted from the clamp mechanism by the single joint elevator.

In one embodiment, a tubular transfer system comprises a boom structure having a first frame telescopically coupled to a second frame; a first actuator configured to extend and retract the first frame relative to the second frame; a clamp mechanism coupled to the first frame and configured to grip and lift a tubular; and a second actuator configured to raise and lower the clamp mechanism relative to the first frame.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure relate to a tubular transfer system for handling tubulars on an oil and gas rig. Embodiments of the disclosure relate to a method of transferring tubulars from a stored location to a well center (and back) on the oil and gas rig. The tubular may comprise a single tubular, or may comprise two, three, or more tubulars connected together forming a tubular stand. The stored location may be a racking board and/or an area on the oil and gas rig that is setback from the well center.

Figure 1A:
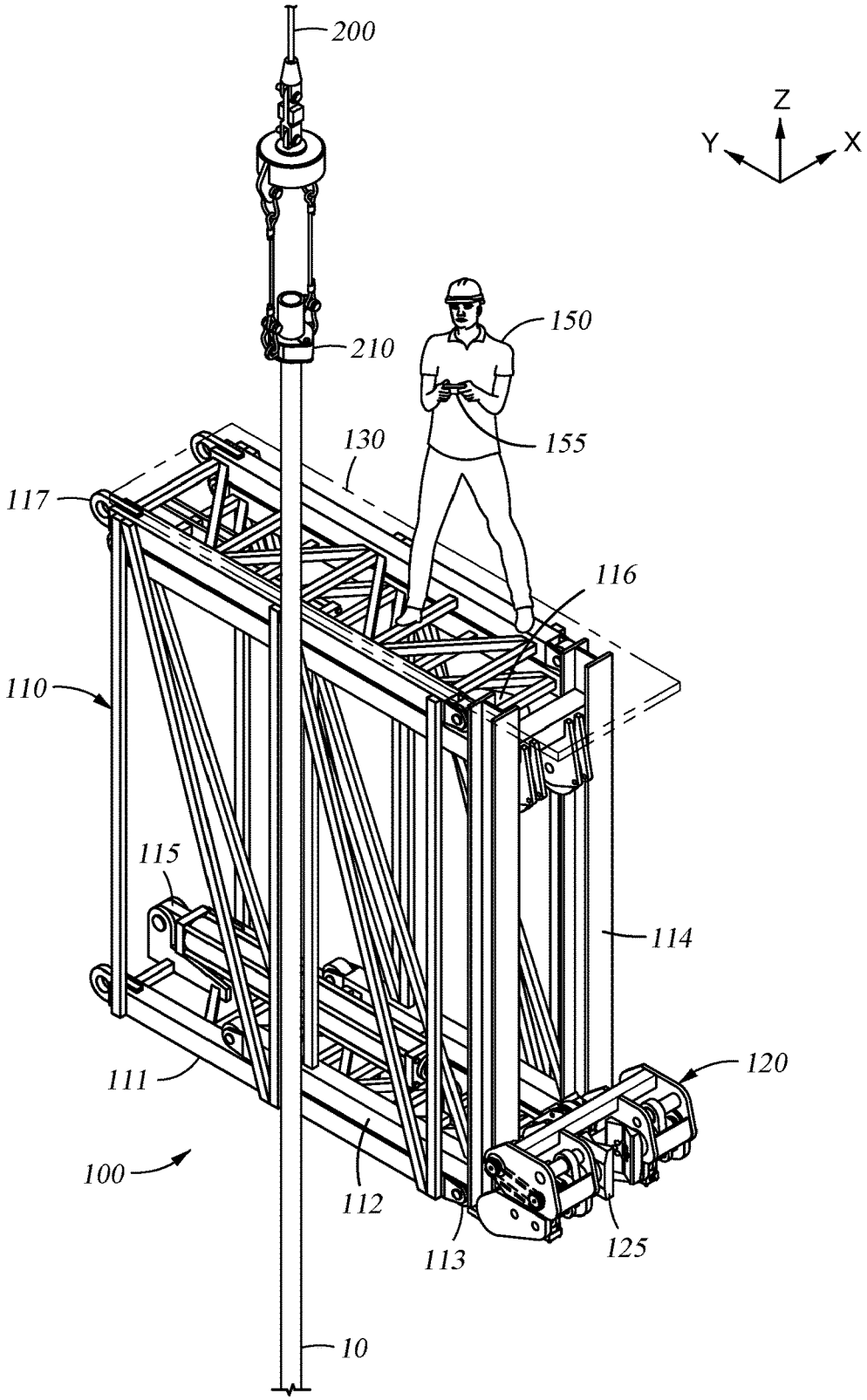
FIGS. 1A-1G illustrate a sequence of transferring a tubular from a stored location to a well center using a tubular transfer system, according to one embodiment.

FIG. 1A is an isometric view of a tubular transfer system 100 having a clamp mechanism 120 coupled to a boom structure 110. The boom structure 110 may be coupled to an oil and gas rig by one or more mount brackets 117. The boom structure 110 may be fixed to the rig or may be movable horizontally in the X-direction and/or vertically in the Z-direction. The tubular transfer system 100 may be located in a setback area that is in proximity to the well center of the rig.

The tubular transfer system 100 is positioned below existing diving board(s) of the rig. A platform 130 may be positioned on top of the boom structure 110 to integrate a diving board to the tubular transfer system 100. A derrickman 150 can work on the platform 130 to help connect and disconnect a single joint elevator 210 of an offline activity crane 200 to and from a tubular 10. The derrickman 150 may have a controller 155 configured to operate the crane 200 and the tubular transfer system 100. One or more tubulars 10 may be made up and stored in the setback area near the tubular transfer system 100.

The boom structure 110 has a first frame, referred to herein as an inner frame 112, that is telescopically coupled to and disposed within a second frame, referred to herein as an outer frame 111. The inner frame 112 can be extended and retracted relative to the outer frame 111 by a first actuator, referred to herein as a piston/cylinder assembly 115.

The piston/cylinder assembly 115 can extend and retract the inner frame 112 horizontally in the Y-direction out from and into the outer frame 111. The piston/cylinder assembly 115 is connected at one end to the outer frame 111 and at an opposite end to the inner frame 112, for example by a rod that is extendable and retractable from the piston/cylinder assembly 115. Although described herein with respect to the piston/cylinder assembly 115, the inner frame 112 can be extended and retracted by other types of hydraulic, pneumatic, electric, and/or mechanical actuated assemblies.

Figure 1B:
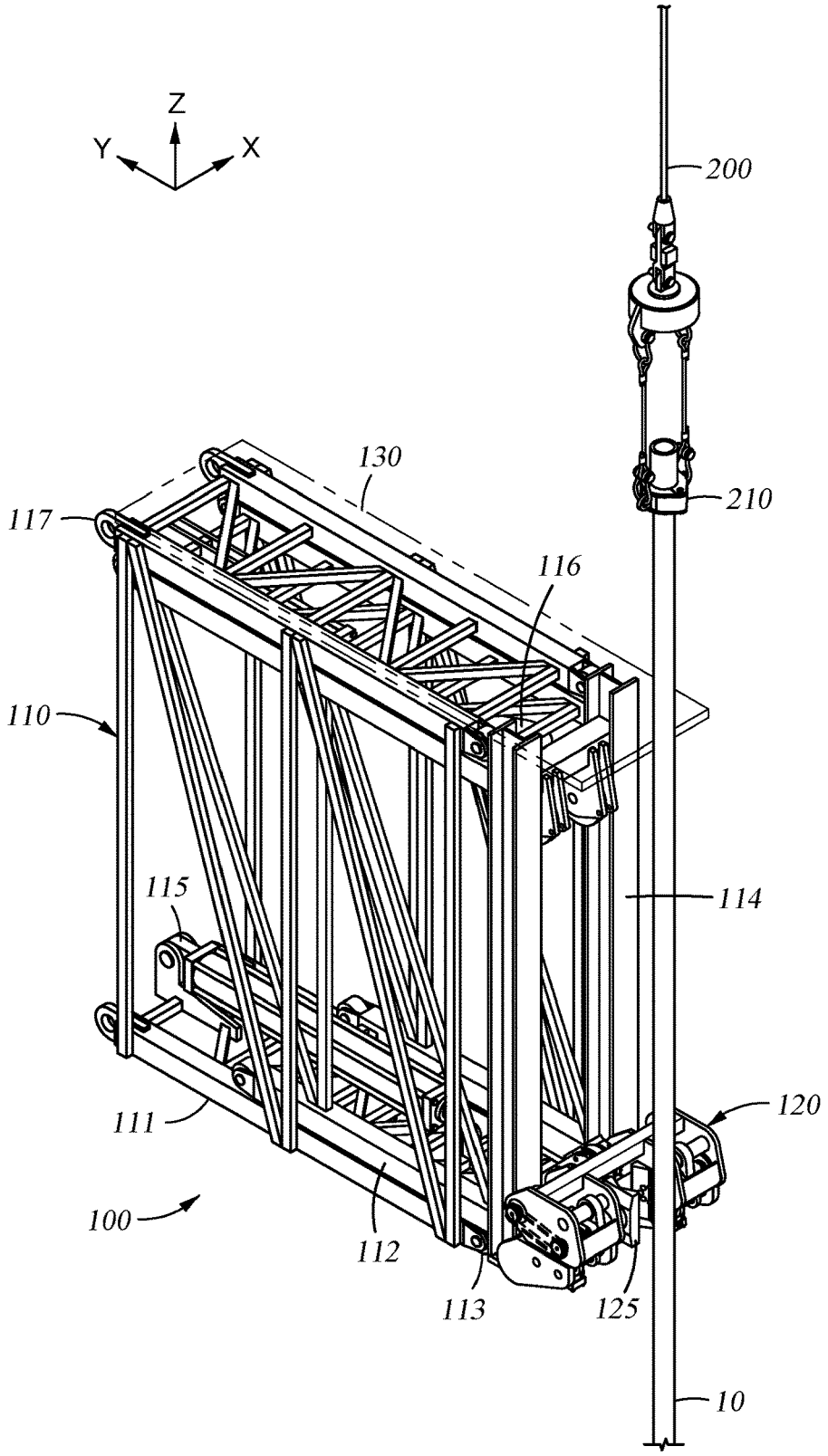
Figure 1C:
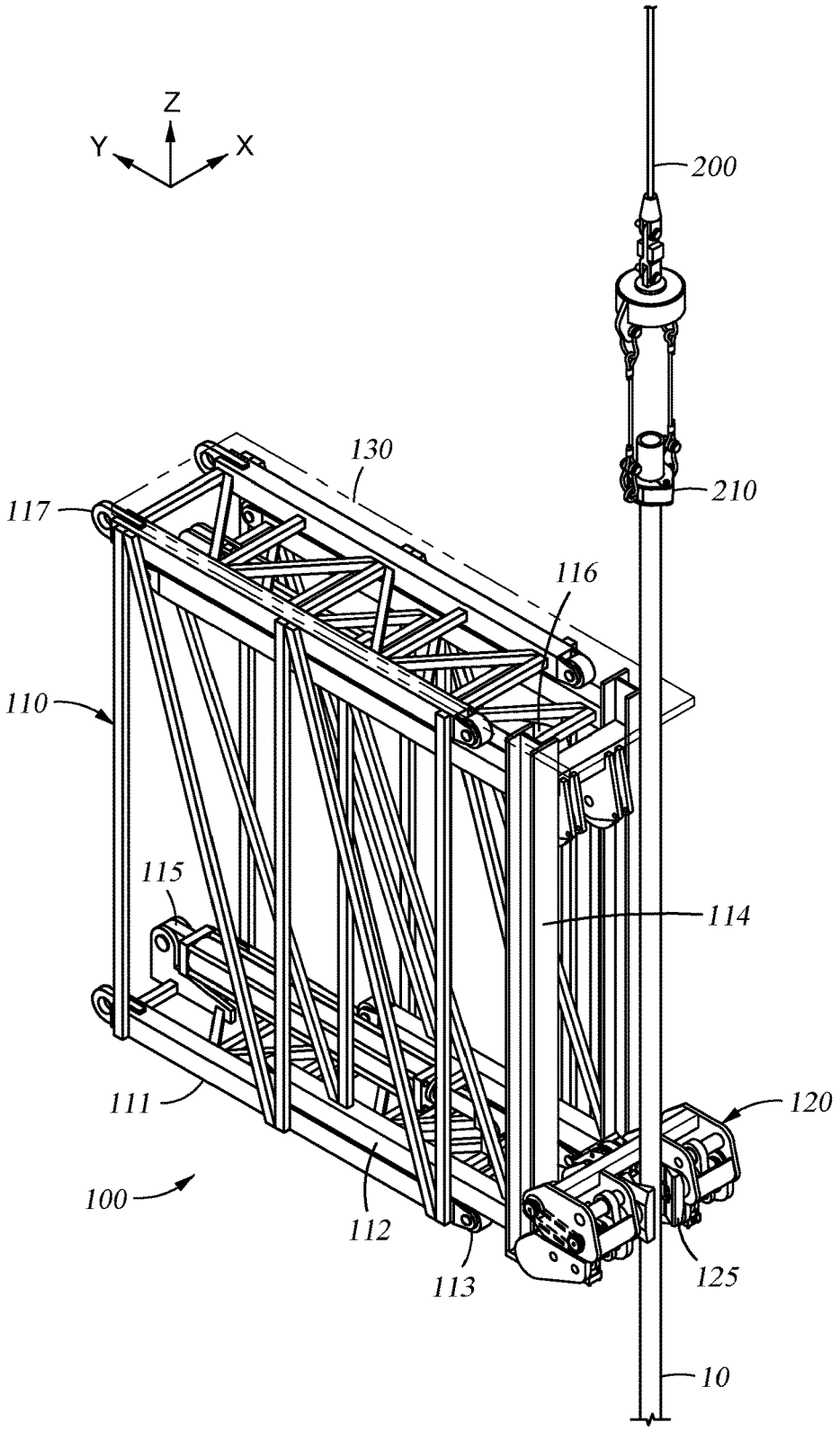
Figure 1D:
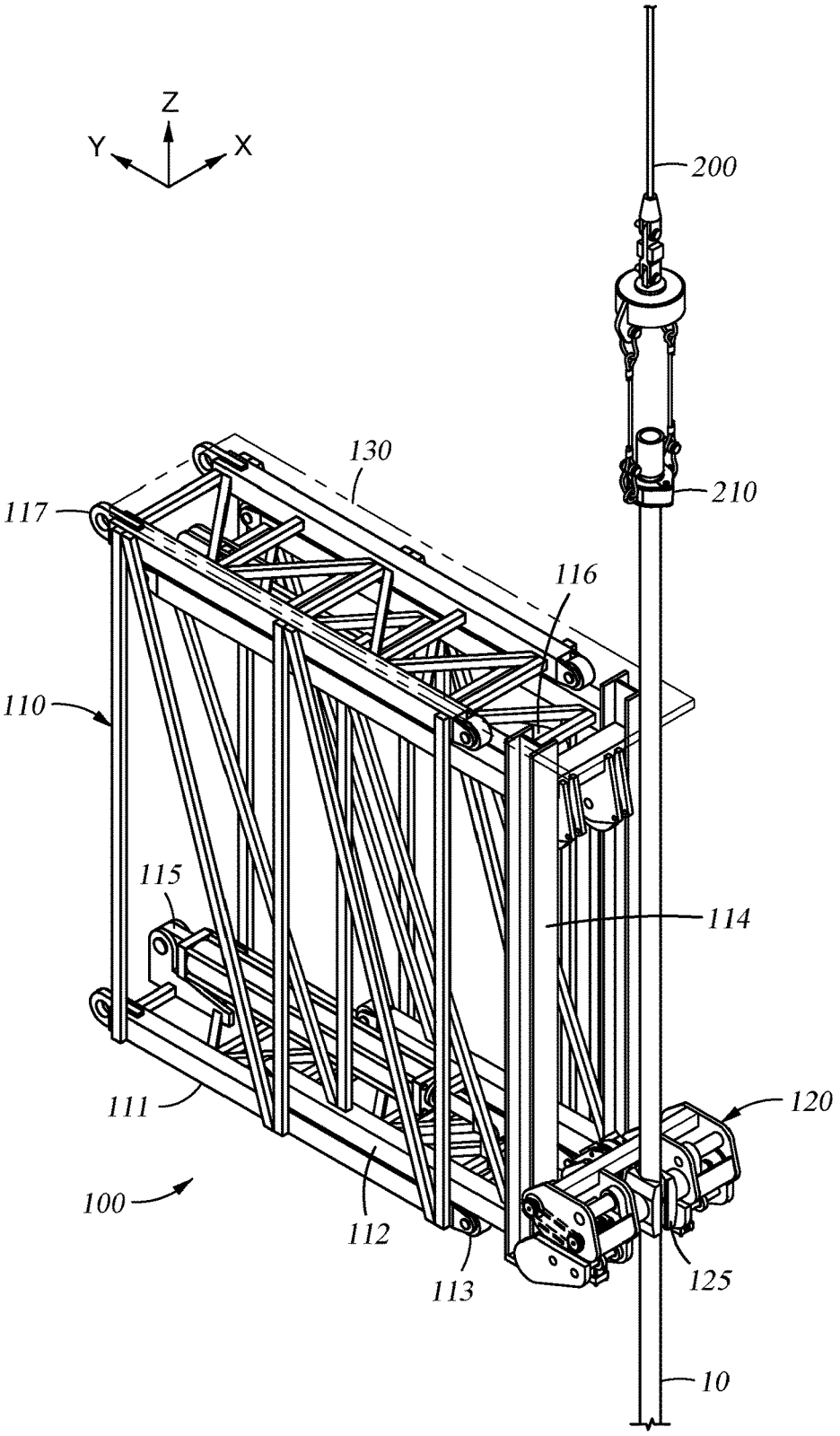
Figure 1E:
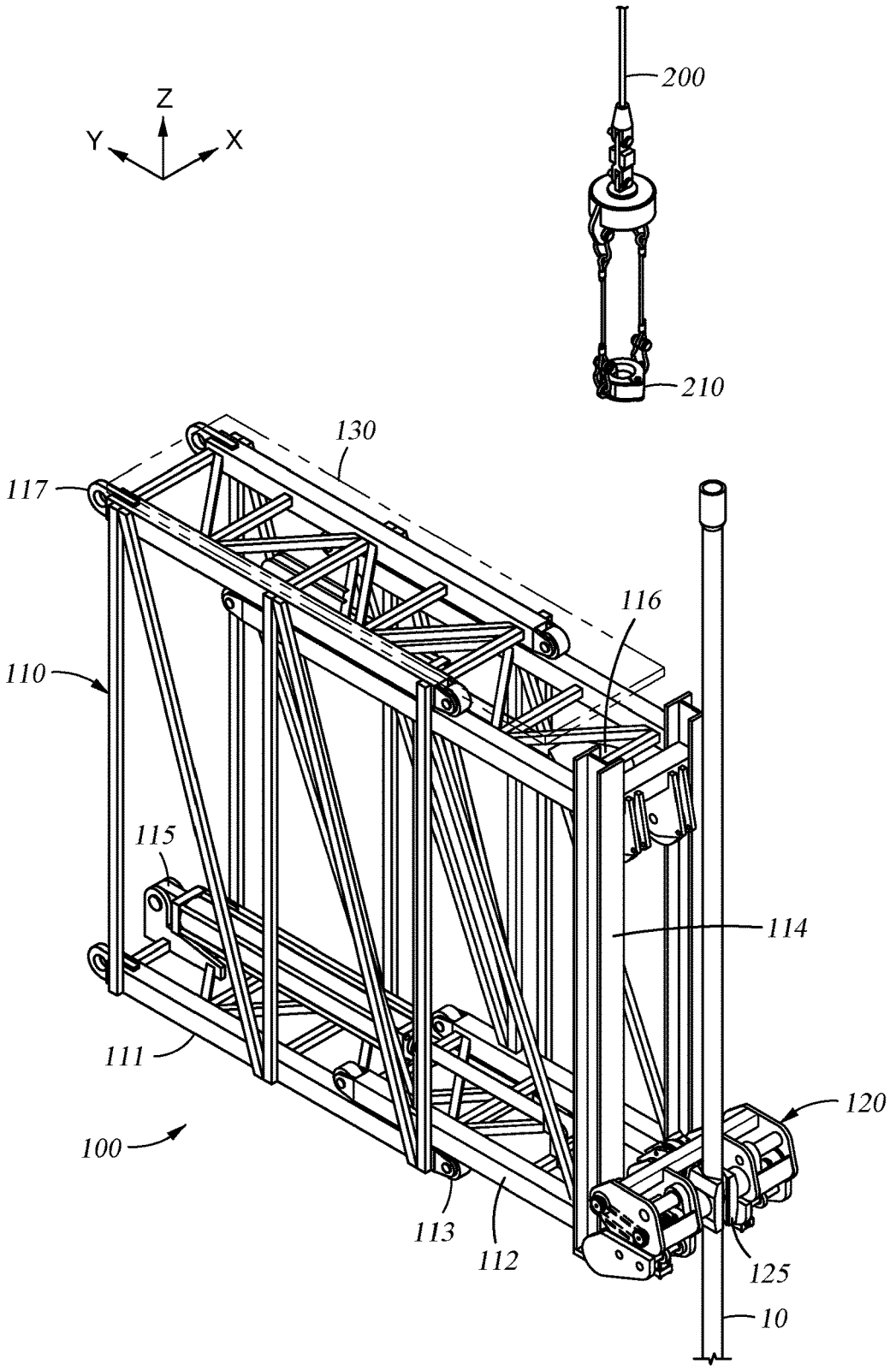
Figure 1F:
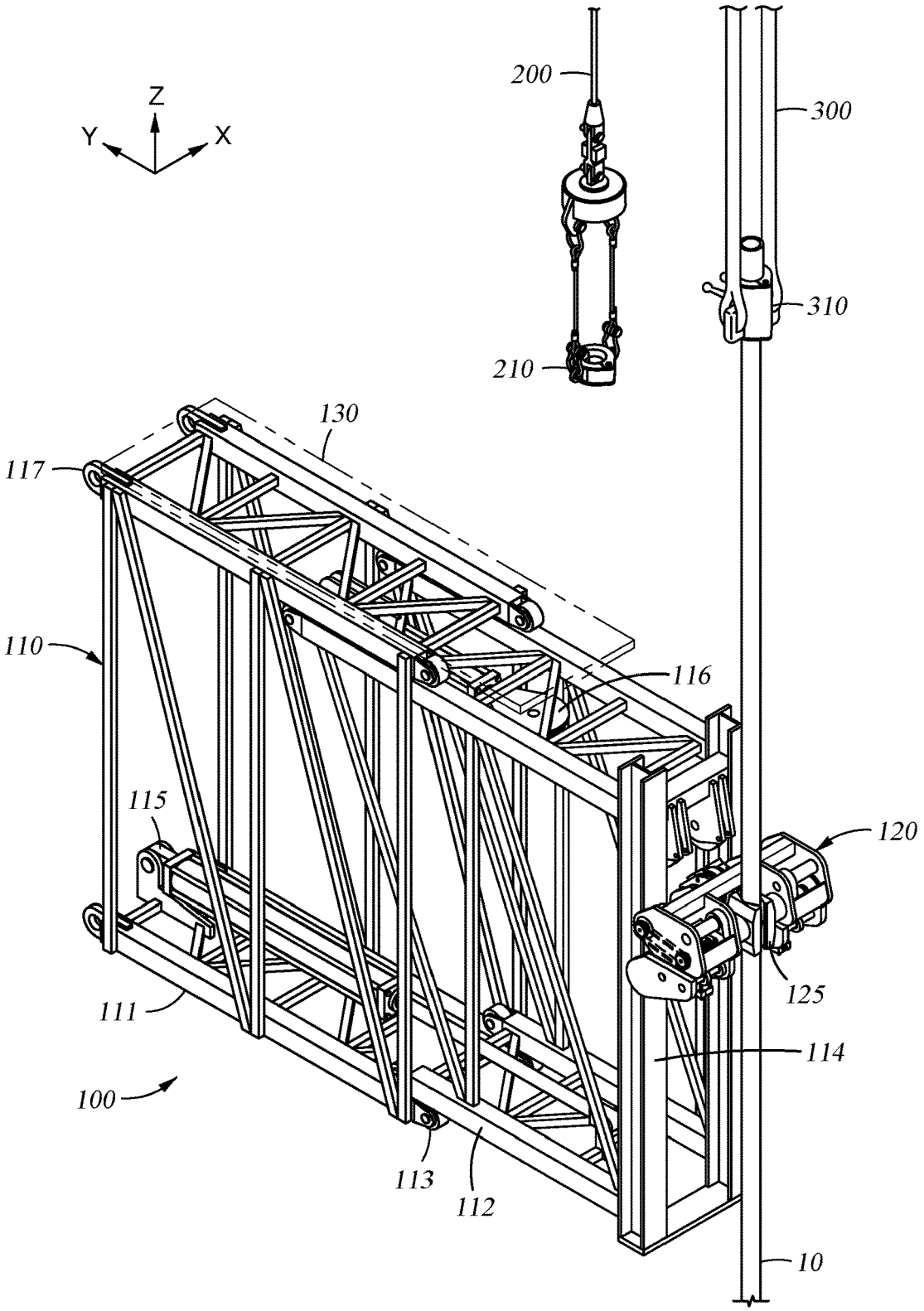

The clamp mechanism 120 is coupled to the inner frame 112 and is movable along a pair of beams 114 by a second actuator, referred to herein as a cable/pulley assembly 116 (more clearly shown in FIG. 1F). The cable/pulley assembly 116 can raise and lower the clamp mechanism 120 along the beams 114. The cable/pulley assembly 116 is connected at one end to the clamp mechanism 120 and at an opposite end to the inner frame 112, for example by a rod that is extendable and retractable from another piston/cylinder assembly. Although described herein with respect to the cable/pulley assembly 116, the clamp mechanism 120 can be raised and lowered by other types of hydraulic, pneumatic, electric, and/or mechanical actuated assemblies.

In an alternative embodiment, the clamp mechanism 120 can be coupled to the outer frame 111 instead of the inner frame 112. The outer frame 111 can be extended and retracted relative to the inner frame 112 by the first actuator. The clamp mechanism 120 can be raised and lowered along the outer frame 111 by the second actuator.

The clamp mechanism 120 can grip, lift, and transfer various sizes of tubulars from the stored location to the well center of the rig. The clamp force of the clamp mechanism 120 is a function of the weight of the tubular 10, which provides a suitable amount of grip without crushing lighter/thinner walled tubulars or under clamping heavier/thicker walled tubulars. The clamp mechanism 120 will not drop or lose grip on the tubular 10 upon loss of power to the rig.

FIGS. 1A-1G illustrate a sequence of transferring the tubular 10 from a stored location to the well center of the rig using the tubular transfer system 100, according to one embodiment.

In FIG. 1A, the tubular transfer system 100 is in a retracted position and the tubular 10 is in the stored location. The single joint elevator 210 is connected to the upper end of the tubular 10, such as by the derrickman 150 standing on the platform 130. The crane 200, which can be operated by the derrickman 150 via the controller 155, lifts the tubular 10 so that the weight of the tubular 10 is supported by the single joint elevator 210.

In FIG. 1B, the crane 200 moves the single joint elevator 210 and the tubular 10 from the stored location to a location in front of the clamp mechanism 120. The tubular 10 is positioned near a pair of jaws 125 of the clamp mechanism 120. The weight of the tubular 10 is still supported by the single joint elevator 210.

In FIG. 1C, the piston/cylinder assembly 115, which can be operated by the derrickman 150 via the controller 155, is actuated to extend the inner frame 112 from the outer frame 111 to move the clamp mechanism 120 closer to the tubular 10. The inner frame 112 moves across one or more rollers 113 that minimize friction between the relative movement of the frames. The clamp mechanism 120 is moved to a position where the tubular 10 is substantially centered between the pair of jaws 125. The weight of the tubular 10 is still supported by the single joint elevator 210.

In FIG. 1D, the clamp mechanism 120, which can be operated by the derrickman 150 via the controller 155, is actuated to grip and lift the tubular 10. The clamp mechanism 120 does not need to engage and grip the tubular 10 at the same location (e.g. the upper box section of the tubular 10) as the single joint elevator 210. The clamp mechanism 120 grips and slightly lifts the tubular 10 to relieve the weight of the tubular 10 from the single joint elevator 210. The clamp mechanism 120 slightly lifts the tubular 10 without assistance from the cable/pulley assembly 116. In one embodiment, the clamp mechanism 120 may lift the tubular 10 and/or be raised by the cable/pulley assembly 116 to lift the tubular 10 to relieve the weight of the tubular 10 from the single joint elevator 210.

The single joint elevator 210 can then be disconnected from the tubular 10, such as by the derrickman 150 standing on the platform 130. The weight of the tubular 10 is now supported by the clamp mechanism 120. As a safety measure, the derrickman 150 can confirm that the weight of the tubular 10 is supported by the clamp mechanism 120 before disconnecting the single joint elevator 210 by comparing load measurements received from one or more sensors on the crane 200 and the clamp mechanism 120.

In FIG. 1E, the piston/cylinder assembly 115, which can be operated by the derrickman 150 via the controller 155, is actuated to further extend the inner frame 112 from the outer frame 111 to move the clamp mechanism 120 and the tubular 10 closer to the well center. The inner frame 112 may be in a fully extended position from the outer frame 111. The weight of the tubular 10 is still supported by the clamp mechanism 120.

In FIG. 1F, the cable/pulley assembly 116, which can be operated by the derrickman 150 via the controller 155, is actuated to move the clamp mechanism 120 and the tubular 10 to a position for transfer over to a top drive elevator 310 of a top drive 300. The cable/pulley assembly raises the clamp mechanism 120 and the tubular 10 up along the beams 114 to the position for engagement by the top drive elevator 310. The top drive elevator 310 is connected to the upper end of the tubular 10 and raises the tubular 10 to relieve the weight of the tubular 10 from the clamp mechanism 120.

The clamp mechanism 120 is configured to automatically release the tubular 10 upon lifting of the tubular 10 from the pair of jaws 125 by the top drive elevator 310 to prevent any damage that otherwise may be caused to the tubular transfer system 100 by pulling on the tubular 10 while not releasing the tubular 10. Before being retracted, the pair of jaws 125 can still prevent the tubular 10 from toppling over in the event that the tubular 10 is inadvertently released from the top drive elevator 310. The weight of the tubular 10 should now be supported by the top drive elevator 310.

Figure 1G:
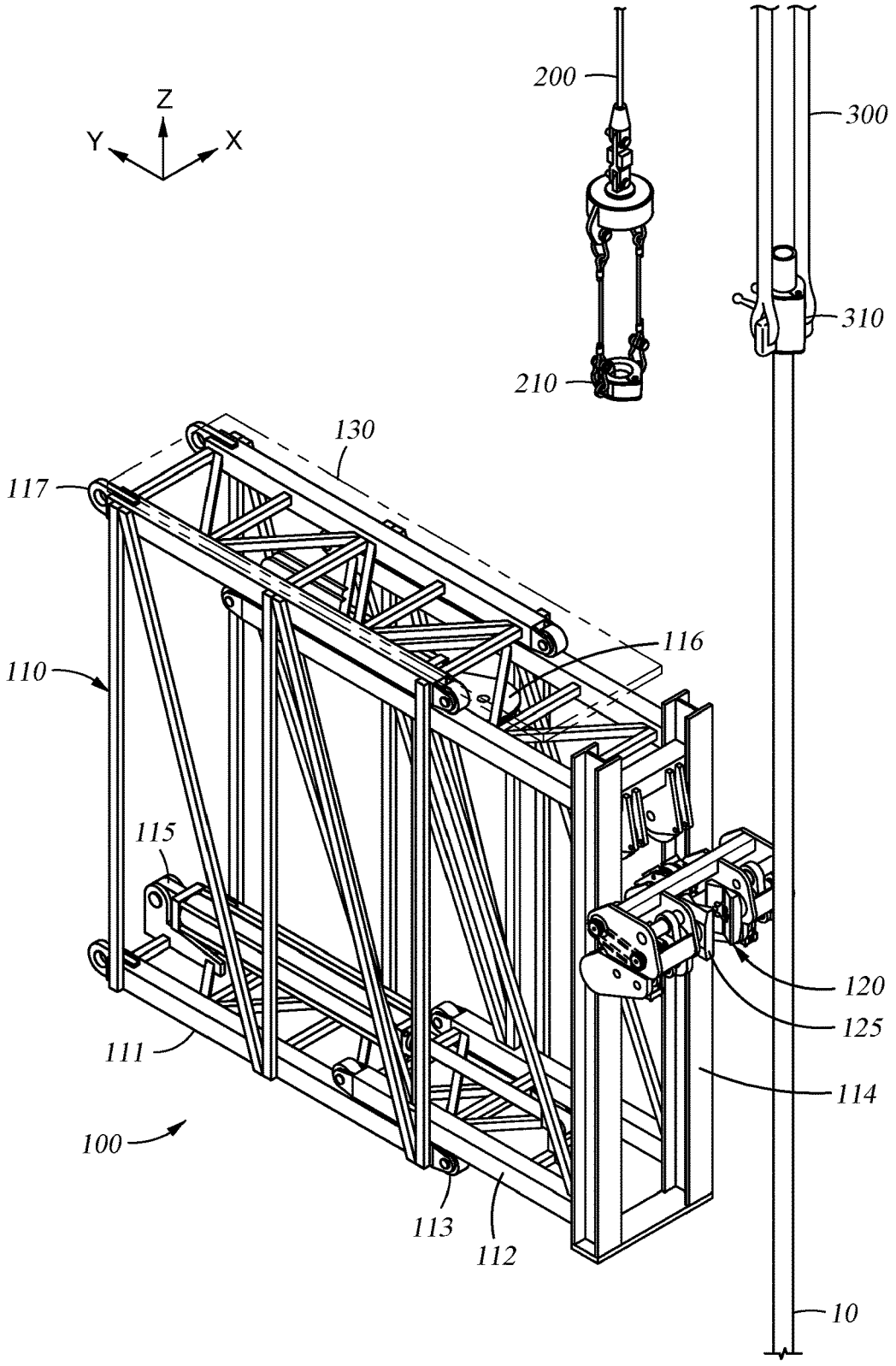

In FIG. 1G, the pair of jaws 125 of the clamp mechanism 120 are retracted from the tubular 10, and the top drive elevator 310 can move the tubular 10 down-hole at the well center. The weight of the tubular 10 is still supported by the top drive elevator 310, and the tubular 10 is moved to the well center for use in an oil and gas recovery or drilling operation. The tubular transfer system 100 is moved back to the retracted position as shown in FIG. 1A for transfer of another tubular to the well center.

FIGS. 2A-2D illustrate a sequence of transferring the tubular 10 from the well center to the stored location using the tubular transfer system, according to one embodiment.

Figure 2A:
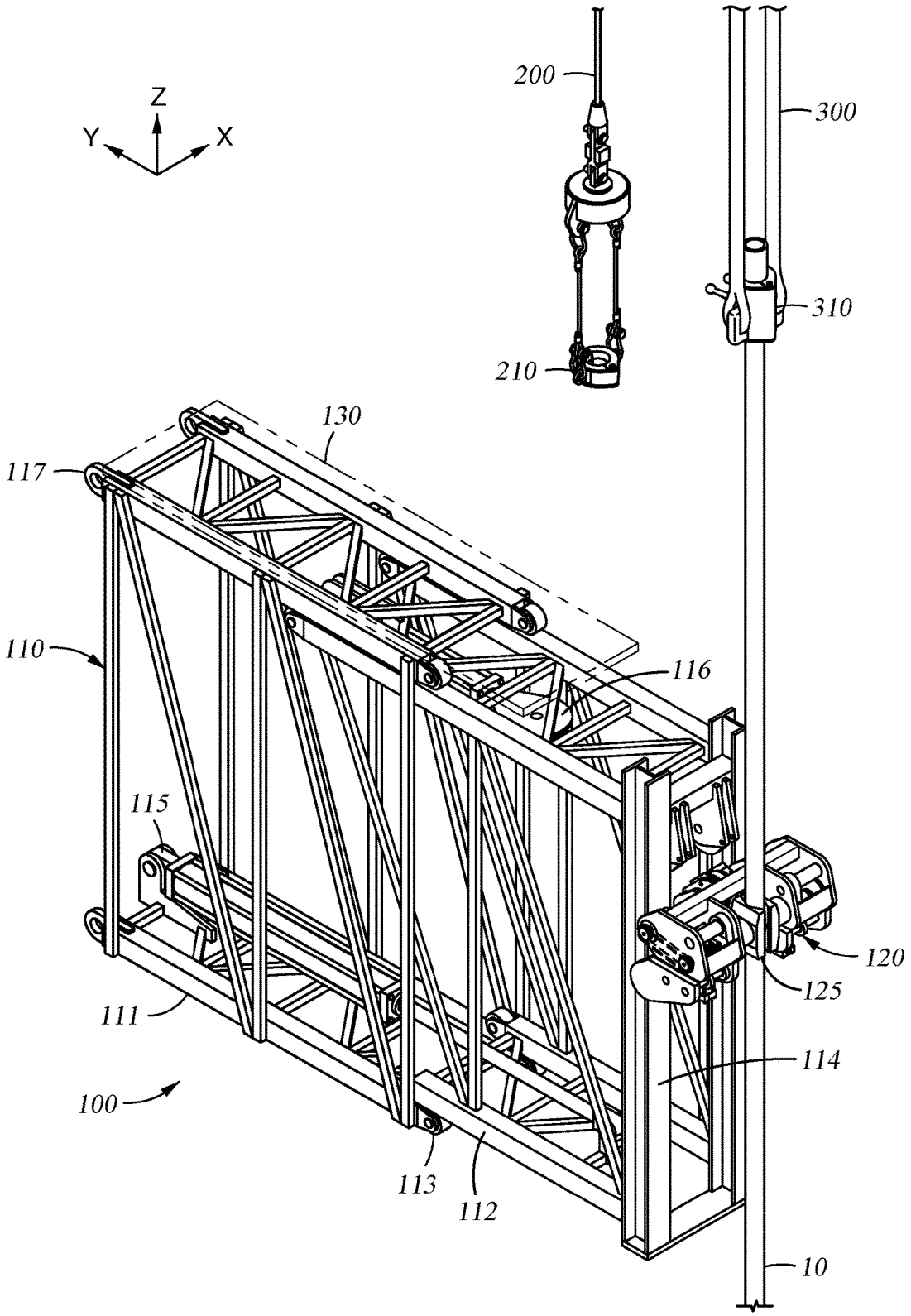
FIGS. 2A-2D illustrate a sequence of transferring a tubular from the well center to the stored location using the tubular transfer system, according to one embodiment.

In FIG. 2A, the tubular 10 is moved from the well center back to a position near the tubular transfer system 100. The piston/cylinder assembly 115 and the cable/pulley assembly 116, which can be operated by the derrickman 150 via the controller 155, are actuated to extend the inner frame 112 and raise the clamp mechanism 120 to a position for engagement of the tubular 10 from the top drive elevator 310. The clamp mechanism 120 is moved to a position where the tubular 10 is substantially centered between the pair of jaws 125 and actuated to grip and lift the tubular 10.

The clamp mechanism 120 grips and slightly lifts the tubular 10 to relieve the weight of the tubular 10 from the top drive elevator 310. The clamp mechanism 120 slightly lifts the tubular 10 without assistance from the cable/pulley assembly 116. In one embodiment, the clamp mechanism 120 may lift the tubular 10 and/or be raised by the cable/pulley assembly 116 to lift the tubular 10 to relieve the weight of the tubular 10 from the top drive elevator 310. The top drive elevator 310 can then be disconnected from the tubular 10. The weight of the tubular 10 is now supported by the clamp mechanism 120. As a safety measure, the derrickman 150 can confirm that the weight of the tubular 10 is supported by the clamp mechanism 120 before the top drive elevator 310 is disconnected by comparing load measurements received from one or more sensors on the clamp mechanism 120.

Figure 2B:
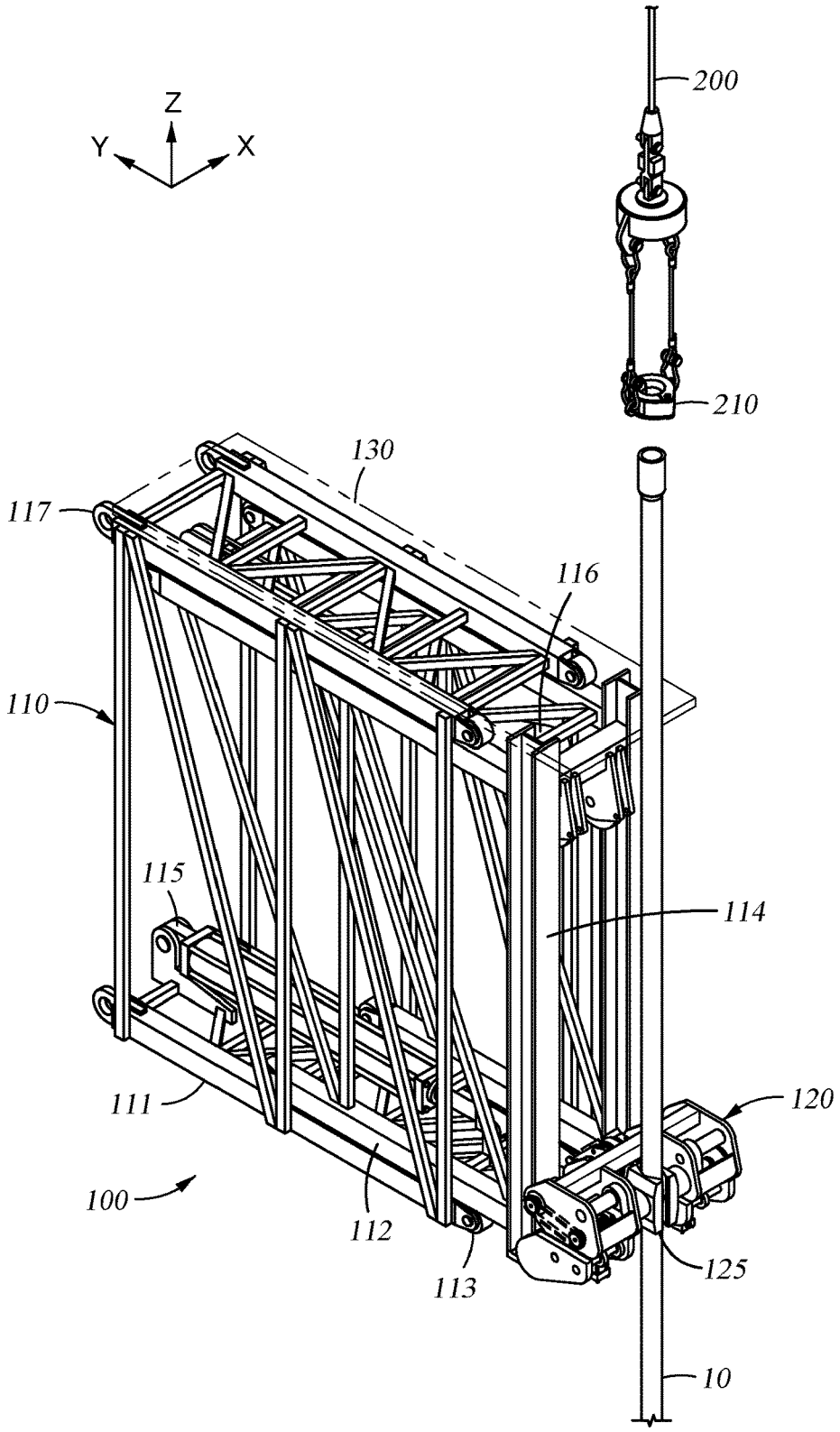

In FIG. 2B, the piston/cylinder assembly 115 and the cable/pulley assembly 116 are actuated to retract the inner frame 112 and lower the clamp mechanism 120 to a position for engagement of the tubular 10 by the single joint elevator 210 near the platform 130. The weight of the tubular 10 is still supported by the clamp mechanism 120.

Figure 2C:
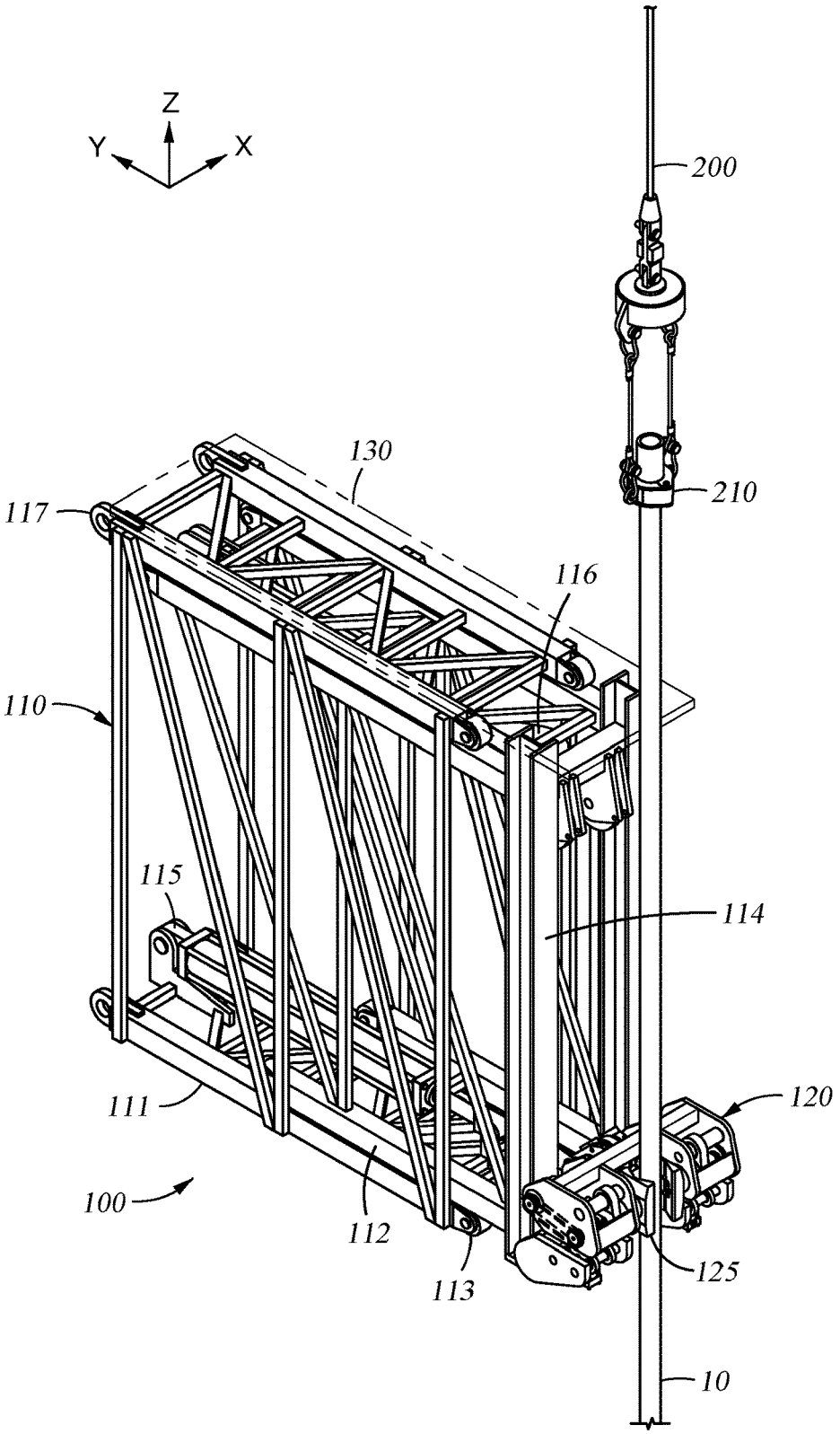

In FIG. 2C, the single joint elevator 210 is connected to the upper end of the tubular 10, such as by the derrickman 150 standing on the platform 130. The crane 200 lifts the tubular 10 to relieve the weight of the tubular 10 from the clamp mechanism 120. The clamp mechanism 120 is configured to automatically release the tubular 10 upon lifting of the tubular 10 from the pair of jaws 125 to prevent any damage that otherwise may be caused to the tubular transfer system 100 by pulling on the tubular 10 while not releasing the tubular 10.

As a safety measure, the derrickman 150 can confirm that the weight of the tubular 10 is supported by the single joint elevator 210 before disconnecting the clamp mechanism 120 by comparing load measurements received from one or more sensors on the crane 200 and the clamp mechanism 120. Before being retracted, the pair of jaws 125 can still prevent the tubular 10 from toppling over in the event that the tubular 10 is inadvertently released from the single joint elevator 210. The pair of jaws 125 are then retracted from the tubular 10 and the weight of the tubular 10 is now freely supported by the single joint elevator 210.

Figure 2D:
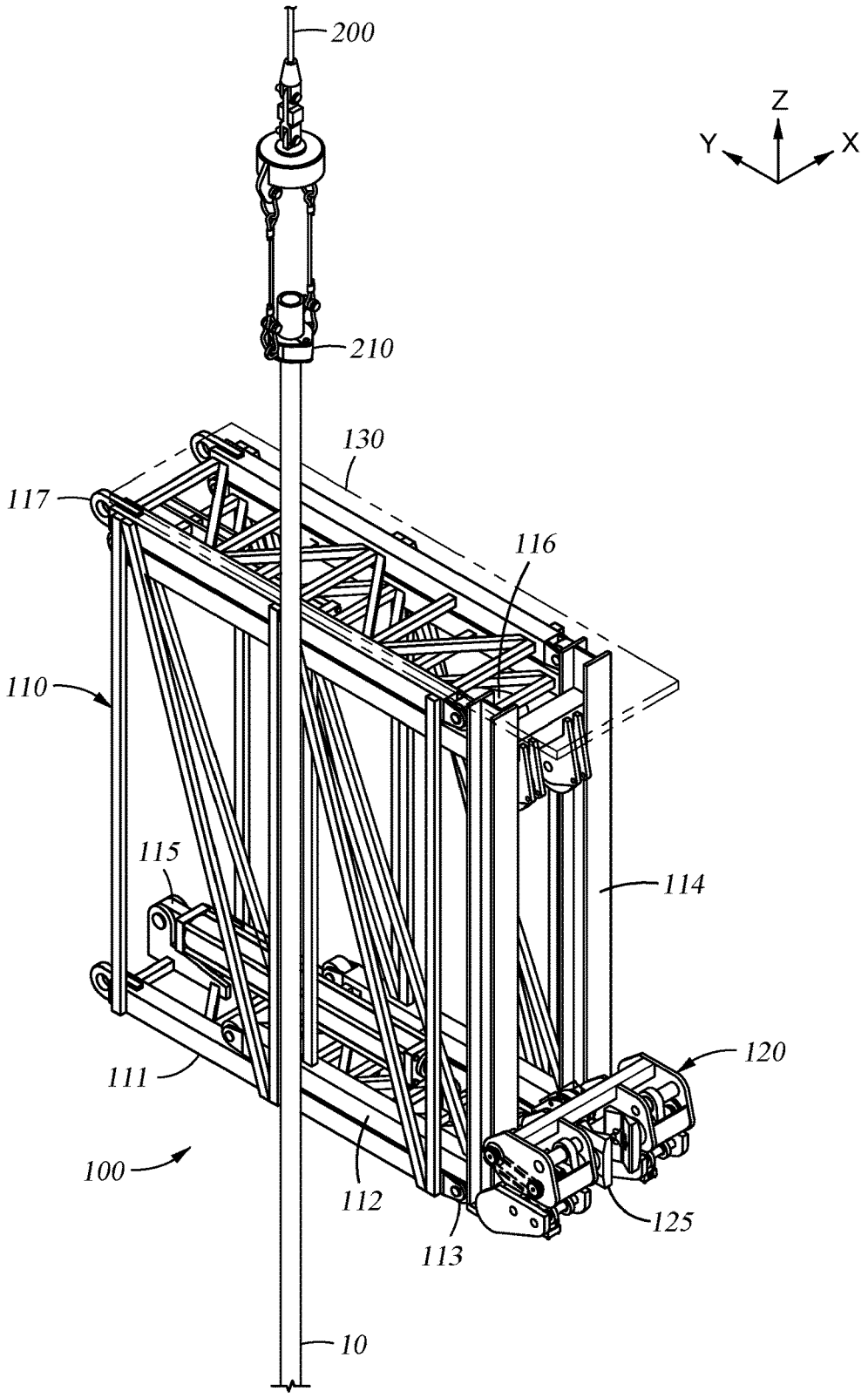

In FIG. 2D, the inner frame 112 is retracted into the outer frame 111 away from interference with the tubular 10. The crane 200 moves the single joint elevator 210 and the tubular 10 back to the stored location. The tubular transfer system 100 is moved back to the extended position as shown in FIG. 2A for transfer of another tubular to the stored location.

The tubular transfer system 100 may include integrated communication protocols to allow for 2-way communication with anti-collision systems (ACS) and/or zone management systems (ZMS) to ensure interaction with and prevent collision/interference with other tubular handling equipment on the rig, such as the top drive elevator 310, the offline activity crane 200, a catwalk, etc. Because the tubular transfer system 100 moves the tubular 10 from the end of the platform 130 over to the well center, the derrickman 150 is no longer required to manually handle the tubular 10 to and from the top drive elevator 310 while engaging or disengaging the single joint elevator 210, thereby minimizing any potential risk of fall or injury. The tubular transfer system 100 has full control of the tubular 10 once gripped by the clamp mechanism 120 to transfer the tubular 10 from the platform 130 to the well center with no physical maneuvering of the tubular 10 by the derrickman 150.

While the foregoing is directed to embodiments of the disclosure, other and further embodiments of the disclosure thus may be devised without departing from the basic scope thereof, and the scope thereof is determined by the claims that follow.

We claim:

1. A method of transferring a tubular from a stored location to a well center of an oil and gas rig using a tubular transfer system, comprising:

moving the tubular from the stored location to a position near the tubular transfer system using a single joint elevator of an offline activity crane;

actuating a boom structure of the tubular transfer system comprising an outer frame, an inner frame disposed within and telescopically coupled to the outer frame, and a clamp mechanism coupled to the inner frame, wherein the inner frame is movable relative to the outer frame along a horizontal direction by a first actuator, wherein the clamp mechanism is moveable relative to the inner frame along a vertical direction by a second actuator;

extending the clamp mechanism along the horizontal direction by actuating the first actuator to telescopically move the inner frame relative to the outer frame to a position where the tubular is centered within the clamp mechanism;

actuating the clamp mechanism of the tubular transfer system to grip and lift the tubular to relieve the weight of the tubular from the single joint elevator;

raising the clamp mechanism along a vertical direction by actuating the second actuator to move the tubular to a position for engagement with a top drive elevator; and automatically releasing the tubular from the clamp mechanism when the tubular is lifted from the clamp mechanism by the top drive elevator.

2. The method of claim 1, wherein actuating the clamp mechanism comprises actuating a pair of jaws to grip and lift the tubular.

3. The method of claim 1, wherein the first actuator is a piston/cylinder assembly.

4. The method of claim 1, wherein raising the clamp mechanism comprises actuating the second actuator to raise the clamp mechanism along a pair of beams of the inner frame.

5. The method of claim 4, wherein the second actuator is a cable/pulley assembly.

6. The method of claim 1, wherein the tubular comprises a single tubular or a tubular stand.

7. A method of transferring a tubular from a well center to a stored location of an oil and gas rig using a tubular transfer system, comprising:

moving the tubular from the well center to a position near the tubular transfer system;

actuating a boom structure of the tubular transfer system comprising an outer frame, an inner frame disposed within and telescopically coupled to the outer frame, and a clamp mechanism coupled to the inner frame, wherein the inner frame is movable relative to the outer frame along a horizontal direction by a first actuator, wherein the clamp mechanism is moveable relative to the inner frame along a vertical direction by a second actuator;

extending the clamp mechanism along the horizontal direction by actuating the first actuator to telescopically move the inner frame outward relative to the outer frame to a position where the tubular is centered within the clamp mechanism;

actuating the clamp mechanism of the tubular transfer system to grip and lift the tubular to relieve the weight of the tubular from the top drive elevator;

retracting the clamp mechanism along the horizontal direction by actuating the first actuator to telescopically move the inner frame inward relative to the outer frame;

lowering the clamp mechanism along the vertical direction by actuating the second actuator to move the tubular to a position for engagement with a single joint elevator of an offline activity crane; and automatically releasing the tubular from the clamp mechanism when the tubular is lifted from the clamp mechanism by the single joint elevator.

8. The method of claim 7, wherein actuating the clamp mechanism comprises actuating a pair of jaws to grip and lift the tubular.

9. The method of claim 7, wherein the first actuator is a piston/cylinder assembly.

10. The method of claim 7, wherein lowering the clamp mechanism comprises actuating the second actuator to lower the clamp mechanism along a pair of beams of the inner frame.

11. The method of claim 10, wherein the second actuator is a cable/pulley assembly.

12. The method of claim 7, wherein the tubular comprises a single tubular or a tubular stand.

* * * * *